US007762108B2

(12) United States Patent
Kim et al.

(10) Patent No.: US 7,762,108 B2
(45) Date of Patent: Jul. 27, 2010

(54) SUSPENSION APPARATUS AND RESONANCE AVOIDING METHOD OF DRUM-TYPE WASHING MACHINE

(75) Inventors: Jae Hyun Kim, Sungnam-si (KR); Si Moon Jeon, Seoul (KR); Gwan Ryong Park, Seoul (KR); Seung Chul Park, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 898 days.

(21) Appl. No.: 11/144,616

(22) Filed: Jun. 6, 2005

(65) Prior Publication Data

US 2007/0089245 A1 Apr. 26, 2007

(30) Foreign Application Priority Data

Jun. 5, 2004 (KR) ..... 10-2004-0041172

(51) Int. Cl.
*D06F 35/00* (2006.01)
*D06F 33/00* (2006.01)
*F16F 15/03* (2006.01)

(52) U.S. Cl. ..... 68/23.1; 68/12.06; 188/267

(58) Field of Classification Search ..... 68/23 R, 68/23.1, 23.3, 12.06, 12.14; 8/158, 159; 188/129, 166, 381, 267.1, 267.2, 268, 267; 267/196, 201, 202, 203
See application file for complete search history.

(56) References Cited

U.S. PATENT DOCUMENTS

| | | | | |
|---|---|---|---|---|
| 5,711,171 | A * | 1/1998 | Uhlin | 68/4 |
| 6,151,930 | A * | 11/2000 | Carlson | 68/12.06 |
| 6,394,239 | B1 * | 5/2002 | Carlson | 188/267.2 |
| 2005/0211517 | A1 * | 9/2005 | Carlson | 188/267 |

FOREIGN PATENT DOCUMENTS

| | | | |
|---|---|---|---|
| DE | 3016915 | | 11/1981 |
| EP | 0 531 917 | * | 3/1993 |
| JP | 3-23894 | * | 1/1991 |
| JP | 03-181637 | * | 8/1991 |
| JP | 2001-120885 | * | 5/2001 |

* cited by examiner

*Primary Examiner*—Michael Kornakov
*Assistant Examiner*—Stephen Ko
(74) *Attorney, Agent, or Firm*—Birch, Stewart, Kolasch & Birch, LLP

(57) ABSTRACT

Disclosed herein is a suspension apparatus and a resonance avoiding method of a drum-type washing machine. The method adjusts elastic moduli of elastic members before a drum reaches a resonance speed during a dehydration cycle of the washing machine. If the rotating speed of the drum exceeds the resonance speed, the method returns the elastic moduli of the elastic members to an initial state, thereby preventing generation of resonance.

6 Claims, 10 Drawing Sheets

SUSPENSION APPARATUS AND RESONANCE AVOIDING METHOD OF DRUM-TYPE WASHING MACHINE

BACKGROUND OF THE INVENTION

1. Field of the Invention

The present invention relates to a suspension apparatus and resonance avoiding method of a drum-type washing machine, and, more particularly, to a suspension apparatus of a drum-type washing machine and a resonance avoiding method which adjusts an elastic modulus of the suspension apparatus during operation of the drum-type washing machine, thereby avoiding generation of resonance.

1. Description of the Related Art

FIG. 1 is a sectional view illustrating a conventional drum-type washing machine.

As shown in FIG. 1, the conventional drum-type washing machine comprises a cabinet assembly 1 forming the outer appearance of the washing machine, a tub 2 mounted in the cabinet assembly 1, a drum 3 rotatably mounted in the tub 2, a motor 4 used to rotate the drum 3, and a spring 5 and a damper 6 used to attenuate vibration transmitted to the tub 2.

The cabinet assembly 1 includes a cabinet 7 forming opposite lateral surfaces and a rear surface of the drum-type washing machine, a top cover 8 mounted at an upper side of the cabinet 7, and a base 9 mounted at a lower side of the cabinet 7.

The spring 5 is mounted between an upper end of the tub 2 and the top cover 8. The damper 6 is mounted between a lower end of the tub 2 and the base 9. Both the spring 5 and the damper 6 serve to compensate for vibration of the tub 2.

In the conventional drum-type washing machine, since the drum 3 is rotated by the motor 4, the washing machine must inevitably pass a resonance range at a specific rotating speed of the drum 3 during a dehydration cycle thereof.

For this reason, in spite of the provision of the spring 5 and the damper 6 as vibration absorbing means, the conventional drum-type washing machine suffers from excess vibration generated as it passes the resonance range during the dehydration cycle.

SUMMARY OF THE INVENTION

Therefore, the present invention has been made in view of the above problems, and it is an object of the present invention to provide a suspension apparatus of a drum-type washing machine and a resonance avoiding method which adjusts an elastic modulus of the suspension apparatus at a rotating speed of a drum causing resonation of the drum-type washing machine, thereby avoiding generation of resonance.

In accordance with a first aspect of the present invention, the above and other objects can be accomplished by the provision of a suspension apparatus of a drum-type washing machine having a cabinet assembly and a tub, the suspension apparatus comprising: a main elastic member mounted between the cabinet assembly and the tub to perform a vibration absorbing operation; an auxiliary elastic member mounted to a first one of the cabinet assembly and the tub; and actuating means making the auxiliary elastic member to perform the vibration absorbing operation. Preferally, said actuating means comprises a solenoid unit mounted at a first end of the auxiliary elastic member to be variably connected to a second one of the cabinet assembly and the tub.

Preferably, the second one of the cabinet assembly and the tub may be provided with a bar to protrude toward the first one of the cabinet assembly and the tub, the solenoid unit may be connected to the bar, and the main elastic member may be mounted between the bar and the first one of the cabinet assembly and the tub.

Preferably, the solenoid unit may be located around the bar to be connected to an outer circumference of the bar using a magnetic force generated therein.

Preferably, the bar may extend vertically, and the first one of the cabinet assembly and the tub may be provided with guide plates to guide movement of the bar.

Meanwhile, in accordance with the first aspect of the present invention, the above and other objects can be accomplished by the provision of a resonance avoiding method of a washing machine having a cabinet assembly, a tub and a drum, the method comprising the steps of: a) accelerating the drum; b) determining whether a rotating speed of the drum reaches a first rotating speed determined by a main elastic member; c) operating a solenoid unit affixed to an auxiliary elastic member before the rotating speed of the drum reaches a first resonance speed to thereby provide a combined elastic force of the main and auxiliary elastic members between the tub and the cabinet assembly; d) determining whether the rotating speed of the drum is greater than the first resonance speed determined by the main elastic member; and e) turning off the solenoid unit if it is determined at the step d) that the rotating speed of the drum is greater than the first resonance speed.

Preferably, the rotating speed of the drum may be set to the first rotating speed less than the first resonance speed at the step b), and the method may be returned to the accelerating step a) when it is determined at the step b) that the rotating speed of the drum is less than the first resonance speed.

Preferably, the rotating speed of the drum may be less than a second resonance speed determined by both the main and auxiliary members at the step d), and also may be less than a second rotating speed where a vibrational displacement curve determined by both the main and auxiliary elastic members intersects a vibrational displacement curve determined by the main elastic member. The method may be returned to the elastic force combing step c) when it is determined at the step d) that the rotating speed of the drum is less than the second rotating speed.

In accordance with a second aspect of the present invention, the above and other objects can be accomplished by the provision of a suspension apparatus of a drum-type washing machine having a cabinet assembly and a tub, the suspension apparatus comprising: a solenoid unit mounted between the cabinet assembly and the tub to be affixed to a first one of the cabinet assembly and the tub using a magnetic force generated therein when electric current is supplied to the solenoid unit; a first elastic member provided between the solenoid unit and the tub to provide an elastic force; and a second elastic member provided between the solenoid unit and the cabinet assembly to provide an elastic force.

Preferably, the elastic force of the first elastic member may be greater than the elastic force of the second elastic member, and when the magnetic force is generated in the solenoid unit, the solenoid unit may be affixed to the tub by overcoming a difference of the elastic forces.

Preferably, the solenoid unit may be protruded toward the tub, and the first elastic member may be located in a space defined in a protruded lower end of the solenoid unit.

Also, in accordance with the second aspect of the present invention, the above and other objects can be accomplished by the provision of a resonance avoiding method of a washing machine having a cabinet assembly, a tub and a drum, the method comprising the steps of: a) accelerating the drum; b) determining whether a rotating speed of the drum reaches a first rotating speed determined by both first and second elastic members; c) operating a solenoid unit before the rotating speed of the drum reaches a first resonance speed to thereby reduce an elastic force of the first and second elastic members, i.e. subtract an elastic force of one of the first and second elastic members; d) determining whether the rotating speed of the drum is greater than the first resonance speed after the step c); and e) turning off the solenoid unit if the rotating speed of the drum is greater than the first resonance speed to thereby return to the combined elastic force state.

Preferably, the rotating speed of the drum may be set to the first rotating speed less than the first resonance speed and a second resonance speed determined by the reduced elastic force at the step b), and the first rotating speed of the drum may be less than a second rotating speed where a vibrational displacement curve determined by both the first and second elastic members intersects a vibrational displacement curve determined by the second elastic member.

Preferably, the method may be returned to the step a) when it is determined at the step b) that the rotating speed of the drum is less than the first rotating speed, and may be returned to the step c) when it is determined at the step d) that the rotating speed of the drum is less than the first resonance speed.

With the above-described configuration, the suspension apparatus of the drum-type washing machine according to the present invention combines or reduces the elastic forces of the respective elastic members, thereby enabling resonance avoiding behavior of the washing machine during a dehydration cycle thereof.

In the suspension apparatus of the drum-type washing machine according to the present invention, the combining or reduction of the elastic forces of the elastic members is achieved based on a magnetic force generated in a solenoid unit. This enables accurate operation of the suspension apparatus.

Further, since the suspension apparatus of the drum-type washing machine according to the present invention does not pass a resonance speed range during a dehydration cycle of the washing machine, it is possible to reduce damage to the washing machine due to excess vibration.

Furthermore, the resonance avoiding method of a washing machine according to the present invention comprises an elastic force combining step or elastic force reducing step before a drum reaches a resonance speed, thereby eliminating generation of excess vibration due to resonance during a dehydration cycle of the washing machine.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of a suspension apparatus and resonance avoiding method of a drum-type washing machine according to the present invention will be described with reference to the accompanying drawings.

Although a plurality of preferred embodiments of the suspension apparatus and resonance avoiding method of the drum-type washing machine can be proposed, hereinafter, the most preferred embodiment will be explained. Also, the basic configuration of the drum-type washing machine is identical to that of the prior art, and thus, a detailed description thereof will be omitted.

Figure 1:
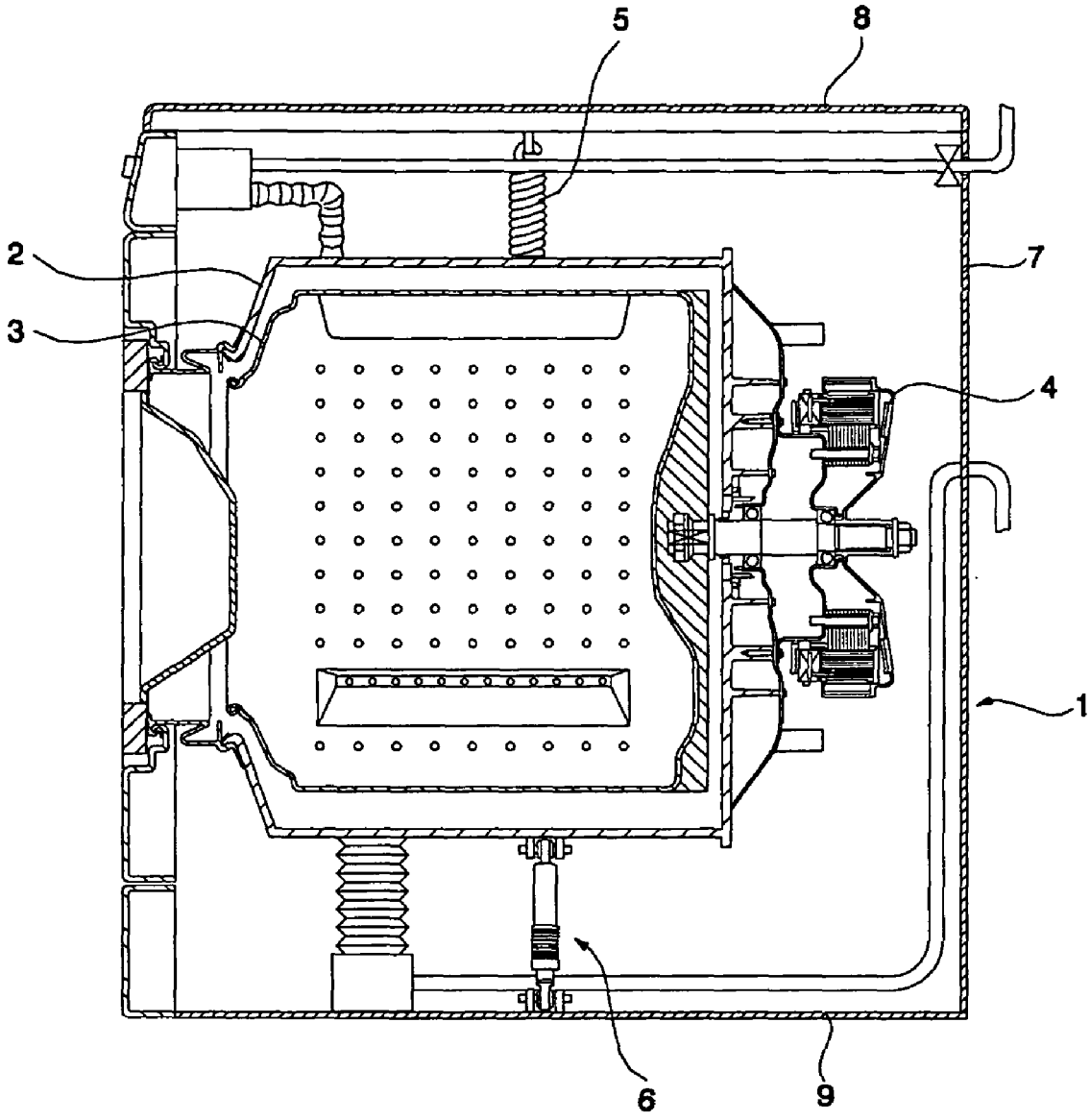
FIG. 1 (Prior Art)
FIG. 1 is a sectional view illustrating a conventional drum-type washing machine.
Figure 2:
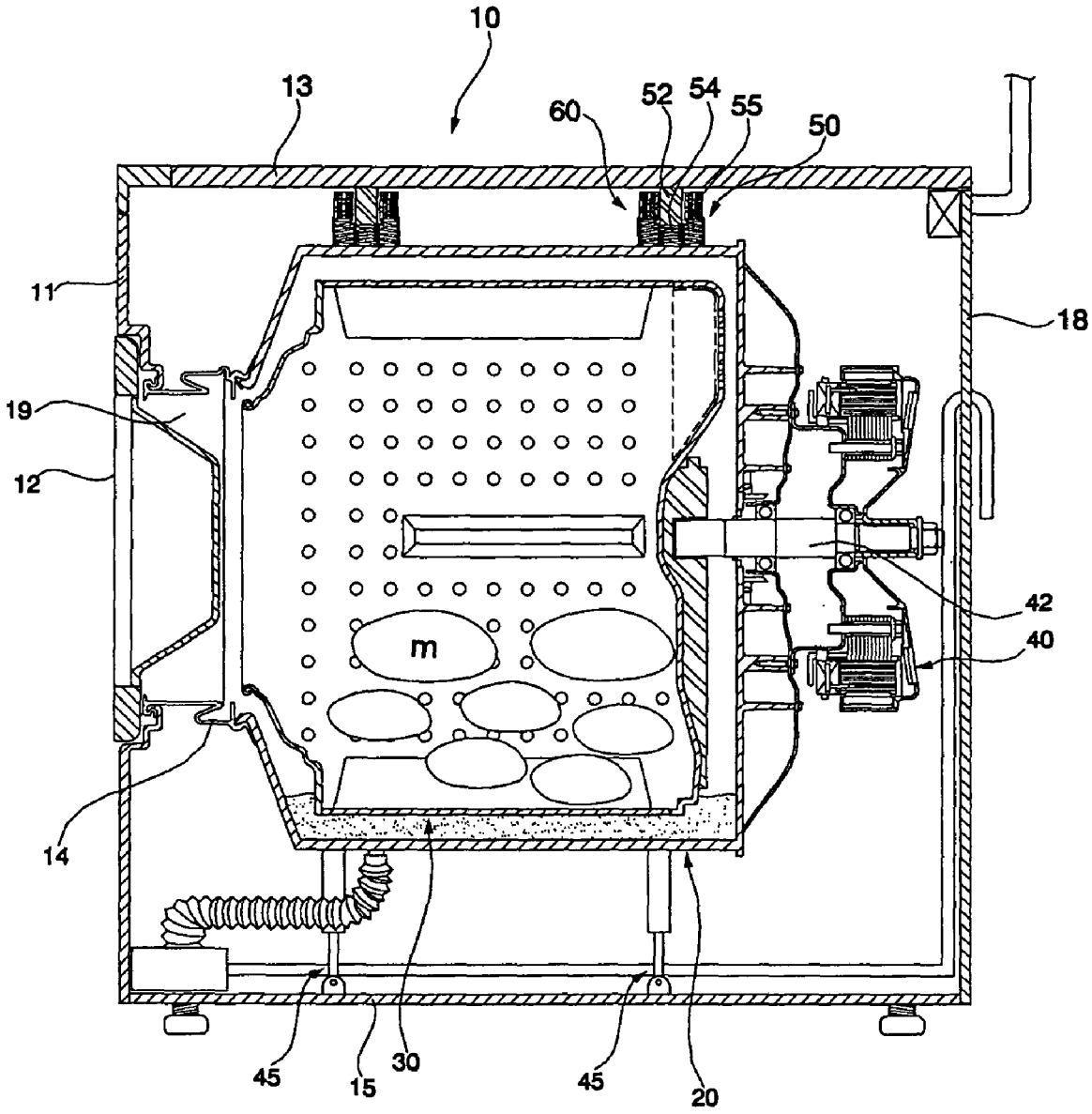
FIG. 2 is a sectional view illustrating the interior configuration of a drum-type washing machine according to the present invention.
Figure 3:
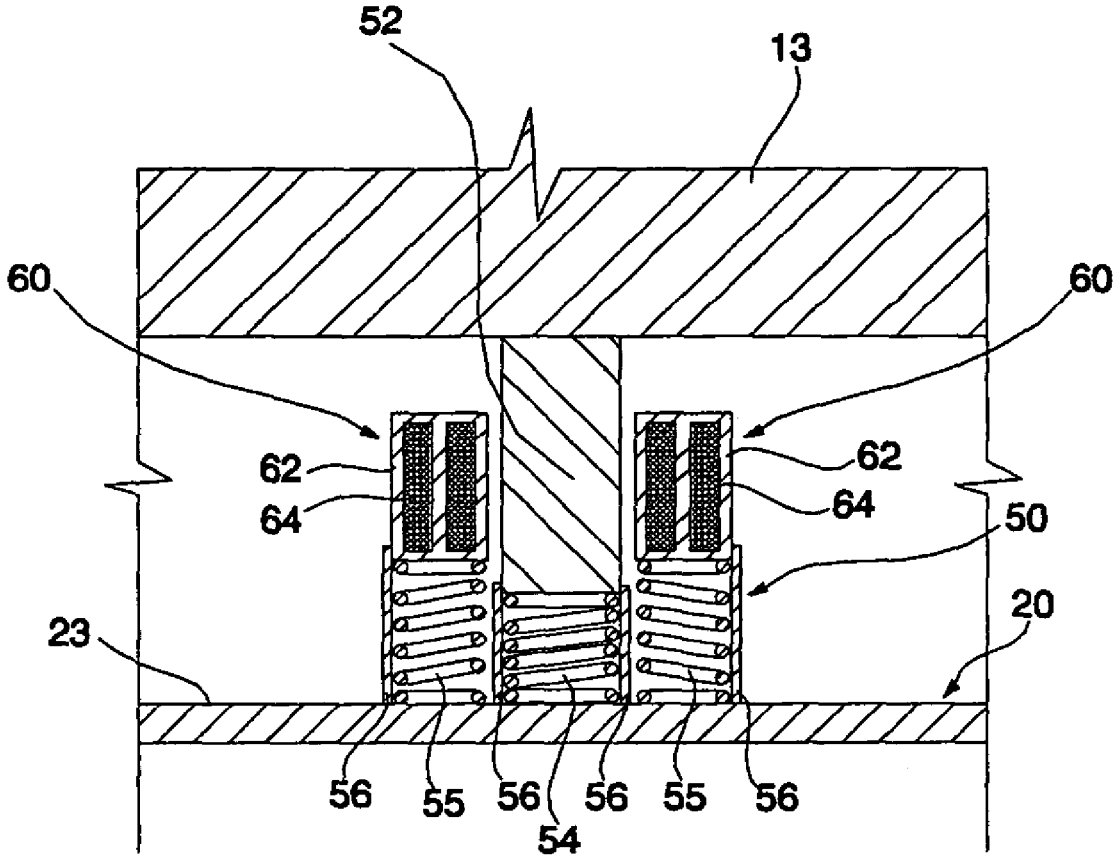
FIG. 3 is a sectional view illustrating a suspension apparatus according to a first embodiment of the present invention.

FIG. 2 is a sectional view illustrating the interior configuration of a drum-type washing machine according to the present invention. FIG. 3 is a sectional view illustrating a suspension apparatus according to a first embodiment of the present invention. FIGS. 4*a* and 4*b* are sectional views exemplifying the operational sequence of the suspension apparatus according to the first embodiment of the present invention.

The washing machine according to the present invention comprises a cabinet assembly 10 forming the outer appearance of the washing machine, a tub 20 mounted in the cabinet assembly 10, a drum 30 rotatably mounted in the tub 20, and a motor 40 used to rotate the drum 30.

The cabinet assembly 10 includes a cabinet 18 forming opposite lateral surfaces and a rear surface of the drum-type washing machine, a cabinet cover 11 mounted at a front side of the cabinet 18, a top cover 13 mounted at an upper side of the cabinet 18, and a base 15 mounted at a lower side of the cabinet 18.

The cabinet cover 11 has an opening 19 and a door 12 mounted to open or close the opening 19. A gasket 14 is mounted between the cabinet cover 11 and the tub 20 to prevent leakage of wash water stored in the tub 20.

The motor 40 has a motor shaft 42, which penetrates through a rear surface of the tub 20 to thereby be connected to the drum 30.

A damper 45 is mounted between the tub 20 and the base 15. Also, a suspension apparatus 50 is mounted between the tub 20 and the top cover 13. Both the damper 45 and the suspension apparatus 50 serve to absorb vibration or shock which would otherwise be transmitted from the tub 20 to the cabinet assembly 10.

Here, the damper 45 is mounted to a lower end of the tub 20, thereby serving to support the tub 20 and to restrict or absorb vibration transmitted from the tub 20.

The suspension apparatus 50 serves to absorb vibration or shock of the tub 20 using an elastic force thereof. For this, the suspension apparatus 50 is designed to change an elastic modulus of elastic members thereof connected to the tub 20 when the drum 30 is rotated at a high-speed exceeding a resonance speed, thereby avoiding resonance of the drum-type washing machine.

As shown in FIG. 3, the suspension apparatus 50 according to the first embodiment of the present invention includes a bar 52 protruded downward from the top cover 13 toward the tub 20, a main elastic member 54 configured to connect a lower end of the bar 52 to an upper surface 23 of the tub 20, an auxiliary elastic member 55 having a lower end affixed to the upper surface 23 of the tub 20 and an upper end facing the top cover 13, and a solenoid unit 60 affixed to the upper end of the auxiliary elastic member 55 to connect the auxiliary elastic member 55 to the bar 52.

Said solenoid unit 60 is operating means which makes the auxiliary elastic member 55 to perform the vibration absorbing operation.

The main and auxiliary elastic members 54 and 55 take the form of elastic springs. The main elastic member 54 is interposed between the bar 52 and the tub 20 to provide an elastic force thereto. The auxiliary elastic member 55 is affixed to the tub 20 to provide an elastic force directed upward.

Here, the solenoid unit 60 is mounted at the upper end of the auxiliary elastic member 55 to move vertically using the elastic force of the auxiliary elastic member 55.

The solenoid unit 60 has a core 62 affixed to the upper end of the auxiliary elastic member 55, and a coil 64 wound around the core 62. When electric current is supplied to the coil 64, the solenoid unit 60 generates a magnetic force via interaction between the core 62 and the coil 64.

With this configuration, when the solenoid unit 60 is in an Off-state, that is, electric current is not supplied to the coil 64, the auxiliary elastic member 55 and the solenoid unit 60 are in a free-motion state. If the solenoid unit 60 is turned on, the core 62 is attached to the bar 52 by the generated magnetic force.

Here, it is preferable that the bar 52 is made of a magnetic or metal material to interact with the magnetic force of the solenoid unit 60.

Meanwhile, guide plates 56 are mounted around the main and auxiliary elastic members 54 and 55 to prevent the members 54 and 55 from dislocating. One of the guide plates 56 mounted around the main elastic member 54, also, serves to guide the vertical movement of the bar 52.

The remaining guide plate 56 mounted around the auxiliary elastic member 55 is protruded upward to prevent the solenoid unit 60 from being spaced apart from the bar 52 beyond a predetermined distance.

Alternatively, the suspension apparatus 50 according to the first embodiment of the present invention may be configured such that the bar is protruded upward from the tub toward the top cover and the main and auxiliary elastic members are affixed to the top cover conversely to the above description.

As occasion demands, a plurality of the suspension apparatuses 50 may be provided.

Figure 4:
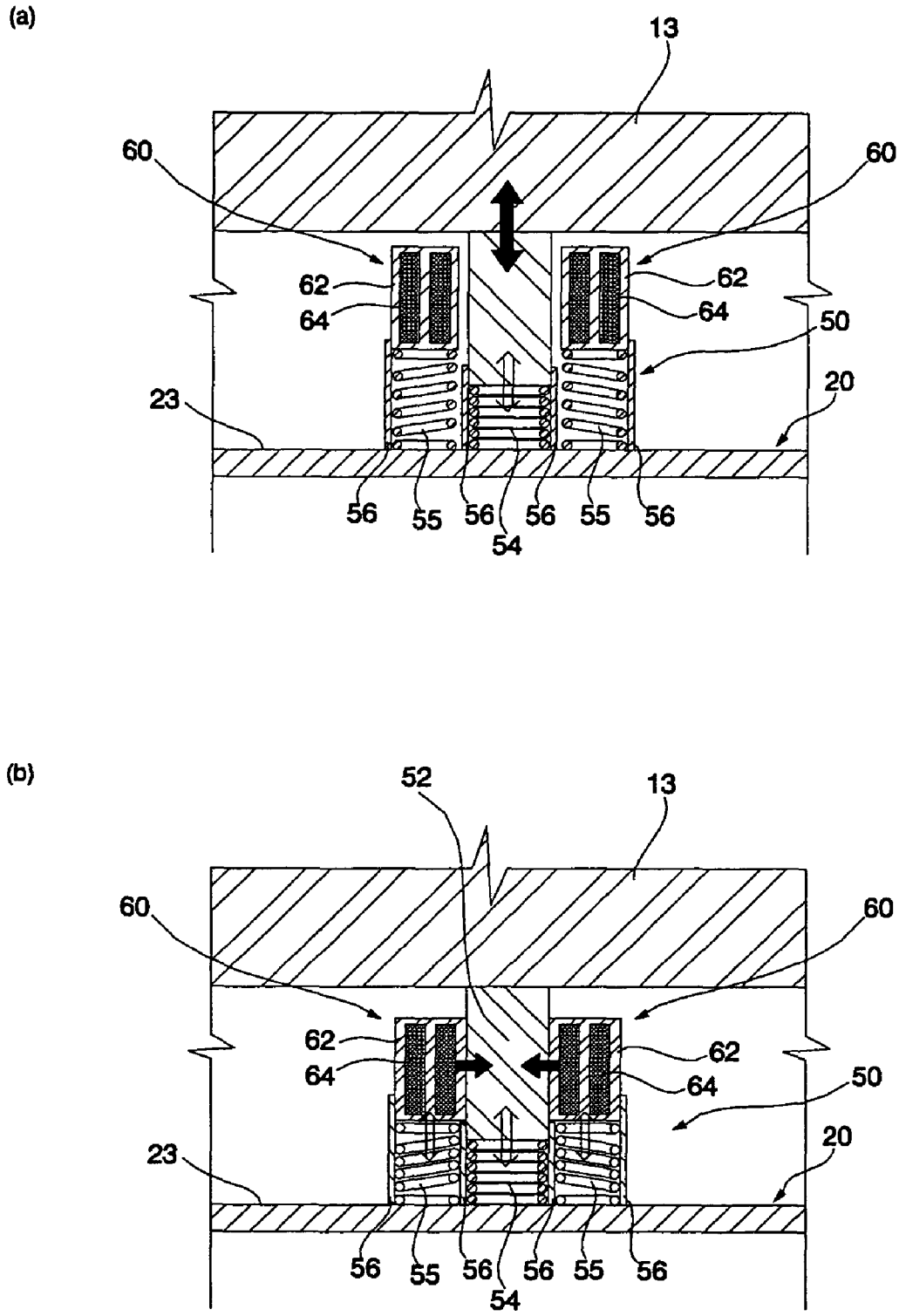
FIGS. 4*a* and 4*b* are sectional views exemplifying the operational sequence of the suspension apparatus according to the first embodiment of the present invention.

Now, the operational sequence of the suspension apparatus of the drum-type washing machine according to the first embodiment of the present invention will be explained in more detail with reference to FIG. 3 or FIG. 4.

First, if electric current is supplied to the solenoid unit 60 under operation of a controller (not shown) provided in the drum-type washing machine, a magnetic force is generated in the solenoid unit 60. Otherwise, if the solenoid unit 60 is in an Off-state, that is, electric current is not supplied to the solenoid unit 60, the suspension apparatus operates as shown in FIG. 4*a*.

That is, when the solenoid unit 60 generates no magnetic force, the suspension apparatus 50 performs an absorbing operation only using the main elastic member 54. In this case, the auxiliary elastic member 55 and the solenoid unit 60 perform free-motion regardless of the main elastic member 54.

If the solenoid unit 60 is turned on upon receiving electric current, the solenoid unit 60, which was performing free-motion, are attached to the bar 52 by virtue of the generated magnetic force.

As the solenoid unit 60 is attached to the bar 52, the suspension apparatus 50 is able to perform a suspension function using the combined elastic force of the main and auxiliary elastic members 54 and 55.

That is, turning on the solenoid unit 60 allows the suspension apparatus 50 to perform a suspension function using a greater elastic force than the elastic force of the main elastic member 54 alone.

Figure 5:
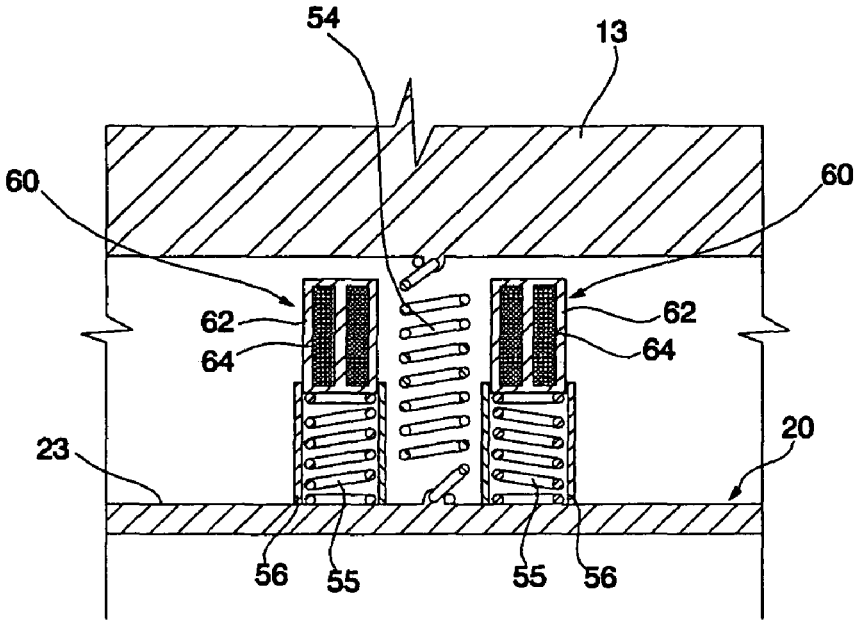
FIG. 5 is a sectional view illustrating a suspension apparatus according to a second embodiment of the present invention.
Figure 6:
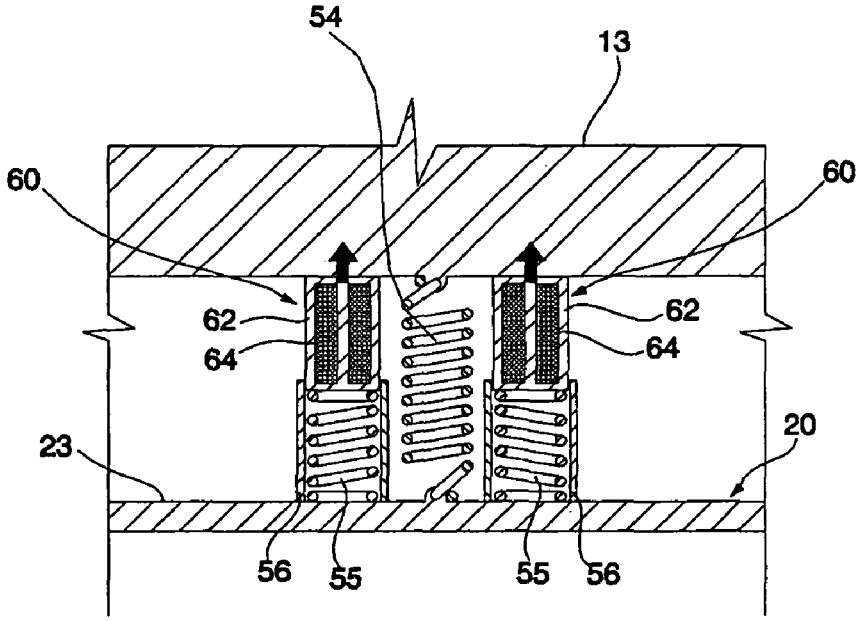
FIG. 6 is a sectional view exemplifying the operation of the suspension apparatus according to the second embodiment of the present invention.

FIG. 5 is a sectional view illustrating a suspension apparatus according to a second embodiment of the present invention. FIG. 6 is a sectional view exemplifying the operation of the suspension apparatus according to the second embodiment of the present invention.

As shown in FIG. 5 or FIG. 6, differently from the first embodiment, the suspension apparatus according to the second embodiment of the present invention is configured such that the main elastic member 54 provides an elastic force between the tub 20 and the top cover 13 without supporting a bar.

With this configuration, when the solenoid unit 60 is turned on, the solenoid unit 60 is directly attached to the top cover 13 to thereby perform a suspension function.

In this case, the top cover 13 is made of a magnetic or metal material to interact with the magnetic force generated in the solenoid unit 60.

The remaining configuration of the second embodiment is identical to the first embodiment, and thus, a detailed explanation thereof will be omitted.

Figure 7:
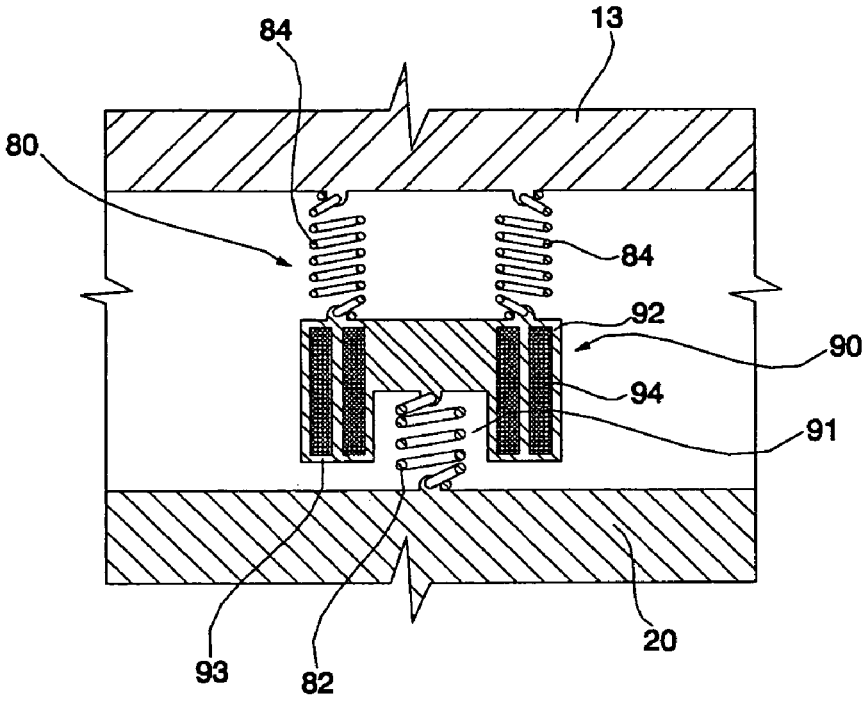
FIG. 7 is a sectional view illustrating a suspension apparatus according to a third embodiment of the present invention.
Figure 8:
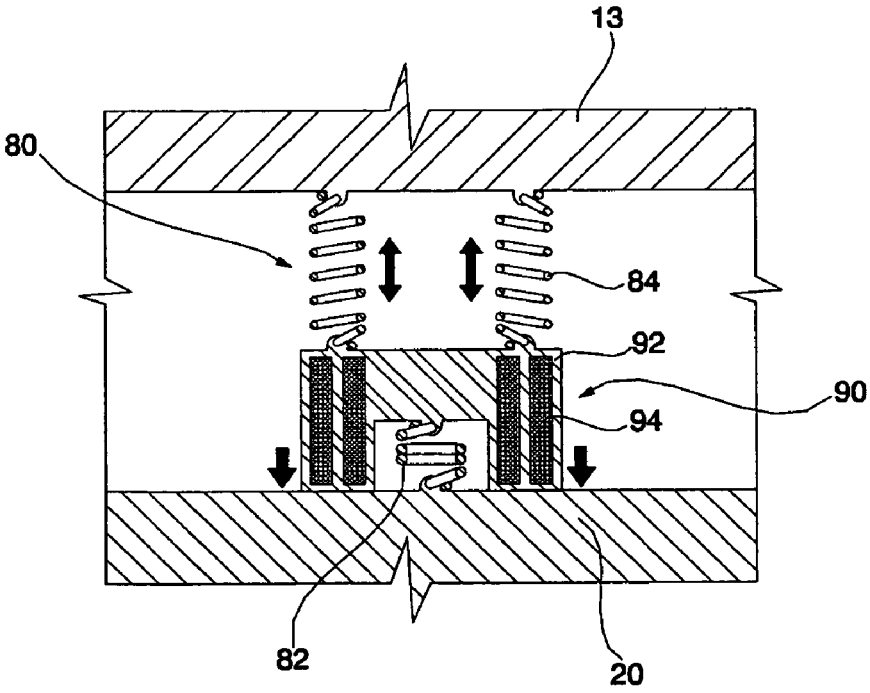
FIG. 8 is a sectional view exemplifying the operation of the suspension apparatus according to the third embodiment of the present invention.

FIG. 7 is a sectional view illustrating a suspension apparatus according to a third embodiment of the present invention. FIG. 8 is a sectional view exemplifying the operation of the suspension apparatus according to the third embodiment of the present invention.

As shown in FIG. 7 or FIG. 8, the suspension apparatus 80 according to the third embodiment of the present invention includes a solenoid unit 90 located between the tub 20 and the top cover 13, a first elastic member 82 provided to connect the tub 20 to the solenoid unit 90, and a second elastic member 84 provided to connect the top cover 13 to the solenoid unit 90.

Here, the first and second elastic members 82 and 84 have different elastic moduli from each other. In the present embodiment, an elastic force of the first elastic member 82 is greater than an elastic force of the second elastic member 84.

The solenoid unit 90 has a core 92 to which the first and second elastic members 82 and 84 are affixed, and a coil 94 wound around the core 92. The core 92 internally defines a space 91 for the installation of the first elastic member 82.

A lower end 93 of the core 92 is partially protruded toward the tub 20, so that the lower end 93 is attached to the tub 20 using a magnetic force generated when the solenoid unit 90 is turned on.

Here, it is preferable that the tub 20 is made of a magnetic or metal material to interact with the magnetic force generated by the solenoid unit 90.

Now, the operational sequence of the suspension apparatus according to the third embodiment of the present invention will be explained in more detail with reference to FIG. 7 or FIG. 8.

First, when the solenoid unit 90 is in an Off-state, the suspension apparatus 80 performs a suspension function using the combined elastic force of the first and second elastic members 82 and 84.

Then, if the solenoid unit 90 is turned on, the solenoid unit 90 is attached to the tub 20 located therebelow by the generated magnetic force, thereby allowing the suspension apparatus 80 to perform a suspension function using the elastic force of the second elastic member 84 alone.

That is, as the solenoid unit 90 is moved downward via interaction with the tub 20 by the generated magnetic force to thereby be attached to the tub 20, the first elastic member 82 is compressed, and the second elastic member 84 is extended. As a result, the suspension apparatus 80 performs a suspension function with a reduced elastic force as compared to the Off-state of the solenoid unit 90.

Meanwhile, the suspension apparatus of the drum-type washing machine according to the present invention provides a resonance avoiding method through the adjustment of the elastic force thereof.

Figure 9:
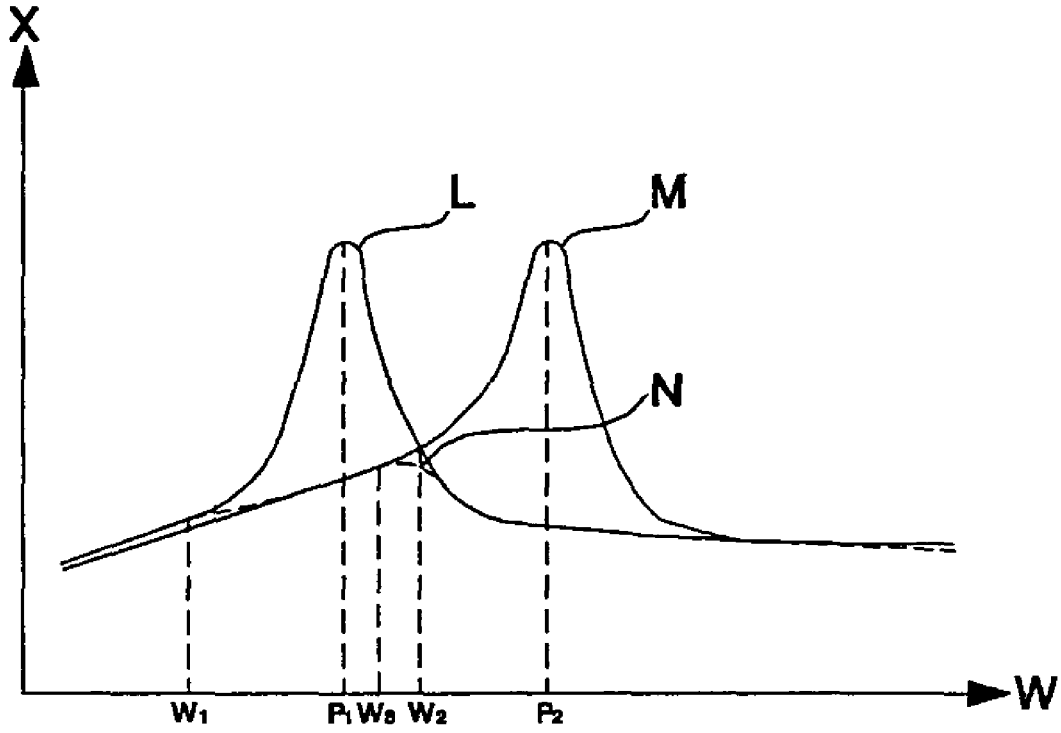
FIG. 9 is a graph illustrating vibrational displacement of the drum-type washing machine according to the first or second embodiment of the present invention.
Figure 10:
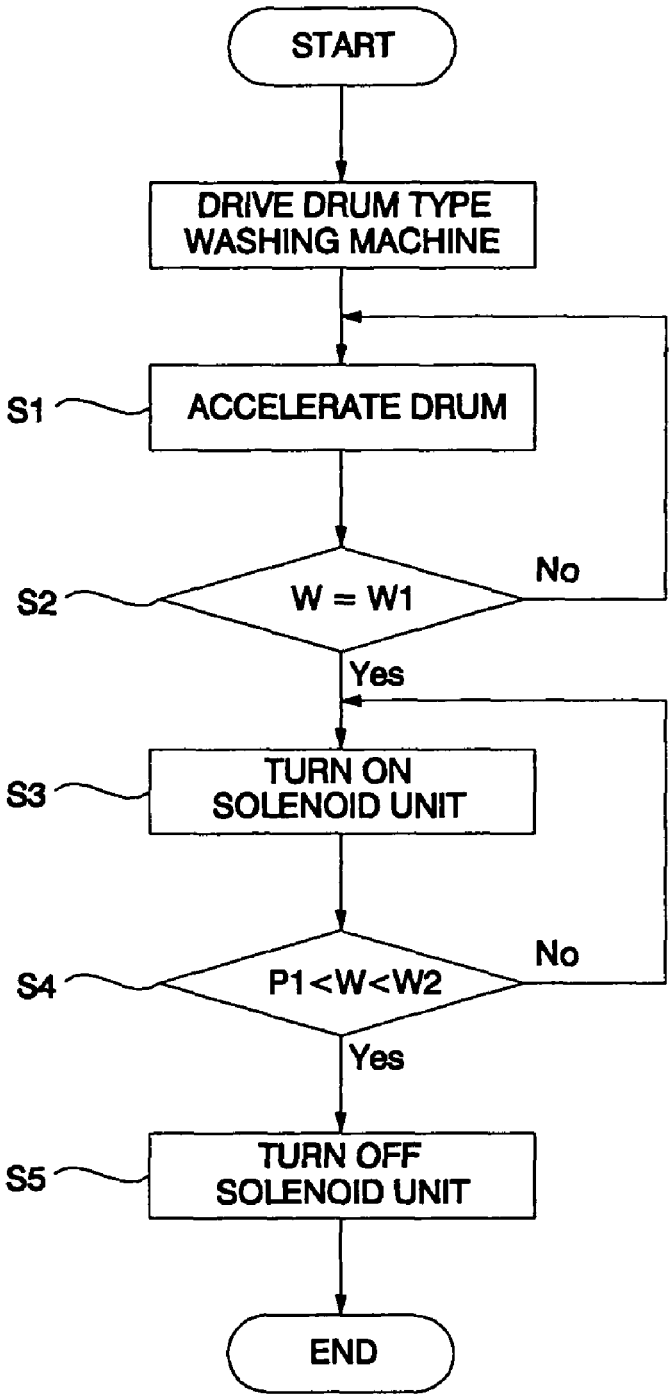
FIG. 10 is a control flow chart illustrating a resonance avoiding method of the drum-type washing machine according to the first or second embodiment of the present invention.

FIG. 9 is a graph illustrating vibrational displacement of the drum-type washing machine according to the first or second embodiment of the present invention. FIG. 10 is a control flow chart illustrating a resonance avoiding method of the drum-type washing machine according to the first or second embodiment of the present invention.

The graph of FIG. 9 shows the relationship between vibrational displacement and rotating speed when a certain elastic force is produced in the suspension apparatus.

In the graph, curve L denotes vibrational displacement of the drum-type washing machine when an elastic force of the main elastic member is provided, and curve M denotes vibrational displacement when the elastic forces of the main and auxiliary elastic members are combined.

Here, it can be seen that the elastic force of the main elastic member alone exhibits a resonance speed P1, and the combined elastic force exhibits a resonance speed P2.

As shown in FIG. 9 or FIG. 10, the resonance avoiding method of the drum-type washing machine according to the first or second embodiment of the present invention comprises accelerating the drum during a dehydration cycle of the washing machine (S1), determining whether a rotating speed W of the drum reaches a rotating speed W1 determined by the main elastic member (S2), operating the solenoid unit affixed to the auxiliary elastic member before the rotating speed W of the drum reaches a resonance speed P1 to thereby produce the combined elastic force of the main and auxiliary elastic member between the tub and the cabinet assembly (S3), determining whether the rotating speed W of the drum is greater than the resonance speed P1 determined by the main elastic member (S4), and turning off the solenoid unit if it is determined at step S4 that the rotating speed W of the drum is greater than the resonance speed P1.

Here, electric current is supplied to the solenoid unit at a time when it is determined at the determination step S2 that the drum reaches the rotating speed W1 showing a rapid vibration increase under the influence of the elastic force of the main elastic member. The supply of electric current to the solenoid unit is interrupted when it is determined at the determination step S4 that the drum reaches a rotating speed W2 where the curves L and M intersect each other.

Preferably, the supply of electric current to the solenoid unit is interrupted at a rotating speed W3 that is less than the rotating speed W2 where the curves L and M intersect each other.

Meanwhile, when the drum-type washing machine is operated based on the above-described resonance avoiding method, the washing machine exhibits vibrational behavior as shown by dotted curve N.

That is, vibrational behavior, generated in the drum-type washing machine, follows the curve L before the rotating speed W1, and then, follows the curve M after the rotating speed W1 because the elastic forces of the respective elastic members are combined. If the supply of electric current is interrupted at the rotating speed W2 exceeding the resonance speed P1, the vibrational behavior again follows the curve L. With this control of vibration via the resonance avoiding method of the present invention, the drum-type washing machine according to the present invention shows vibrational behavior as shown by the curve N.

Meanwhile, if it is determined at the determination step S2 that the drum is less than the rotating speed W1, the resonance avoiding method is returned to the accelerating step S1. Also, if it is determined at the determination step S4 that the rotating speed of the drum is greater than the resonance speed P1 and less than the rotating speed W2, the method is returned to the elastic force combining step S3.

Figure 11:
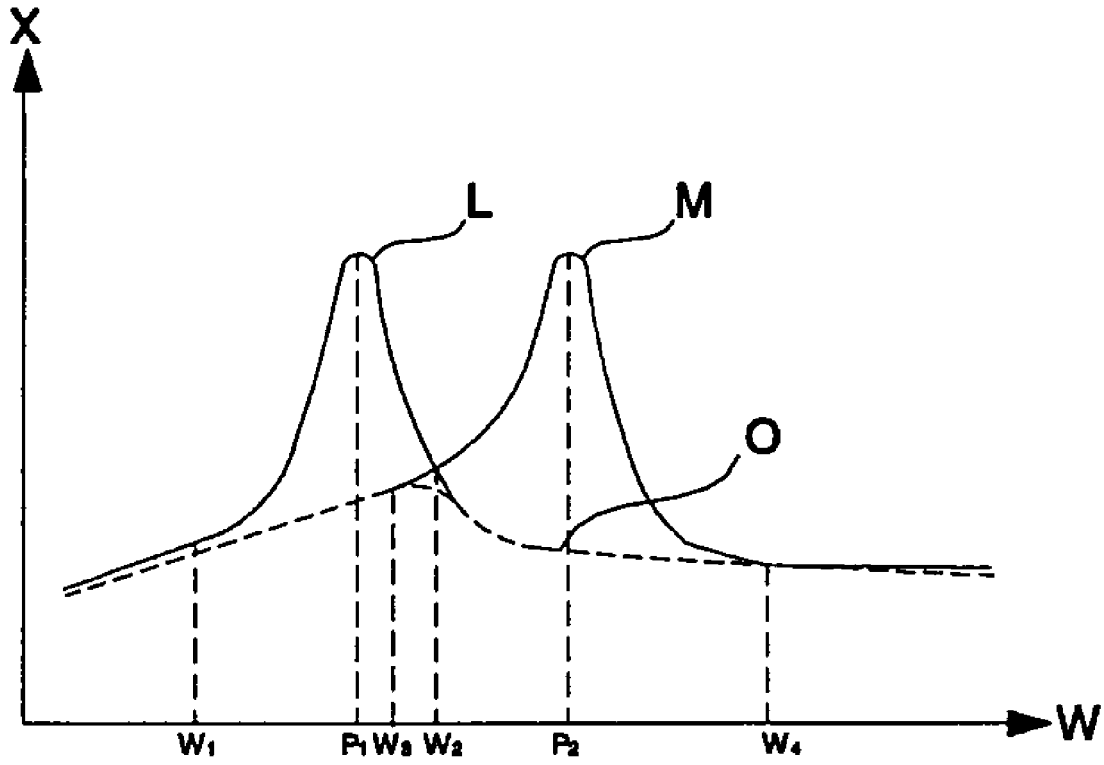
FIG. 11 is a graph illustrating vibrational displacement of the drum-type washing machine according to the third embodiment of the present invention.
Figure 12:
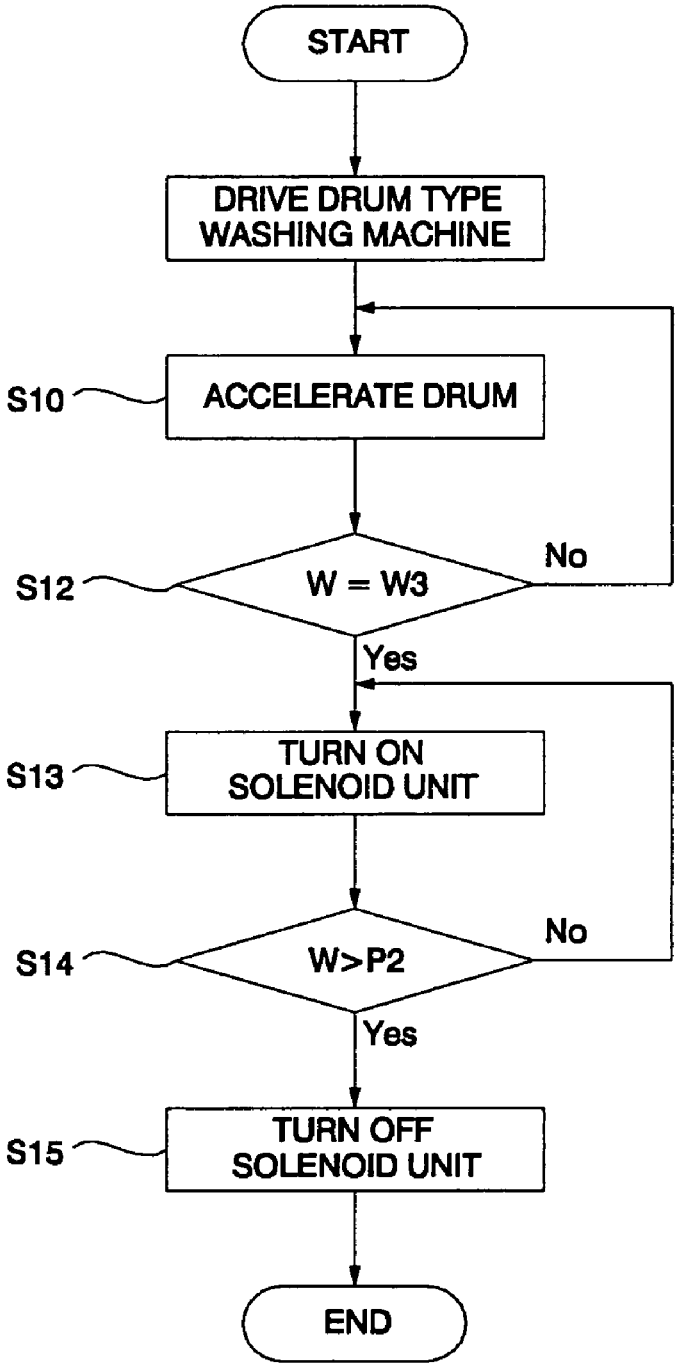
FIG. 12 is a control flow chart illustrating a resonance avoiding method of the drum-type washing machine according to the third embodiment of the present invention.

FIG. 11 is a graph illustrating vibrational displacement of the drum-type washing machine according to the third embodiment of the present invention. FIG. 12 is a control flow chart illustrating a resonance avoiding method of the drum-type washing machine according to the third embodiment of the present invention.

The resonance avoiding method of the drum-type washing machine according to the third embodiment of the present invention is similar to the resonance avoiding method according to the first or second embodiment except for that the elastic force of the suspension apparatus is changed from the combined elastic force to the elastic force of the second elastic member. In this case, vibrational behavior of the drum-type washing machine follows curve M, curve L, and curve M in this sequence.

Here, the curve L denotes vibrational displacement of the drum-type washing machine when the elastic force of the second elastic member is provided, and the curve M denotes vibrational displacement when the elastic forces of the first and second elastic members are combined. Also, the curve O denotes controlled vibrational behavior of the drum-type washing machine according to the third embodiment of the present invention.

As shown in FIG. 11 or FIG. 12, the resonance avoiding method of the drum-type washing machine according to the third embodiment of the present invention comprises accelerating the drum during a dehydration cycle of the washing machine (S10), determining whether the rotating speed W of the drum reaches the rotating speed W3 determined by both the first and second elastic members (S12), operating the solenoid unit before the rotating speed W of the drum reaches the resonance speed P2 to thereby reduce the elastic force of the elastic members, that is, subtract the elastic force of one of the elastic members (S13), determining whether the rotating speed W of the drum is greater than the resonance speed P2 (S14), and turning off the solenoid unit if the rotating speed W of the drum exceeds the resonance speed P2 to thereby return to the combined elastic force state (S15).

Here, the determination step S12 determines whether the rotating speed W of the drum exceeds the rotating speed W3. The rotating speed W3 is greater than the resonance speed P1 determined by the second elastic member and less than the resonance speed P2 determined by both the first and second elastic members. Preferably, the rotating speed W3 is less than the rotating speed W2 where the curves L and M intersect each other.

Therefore, the resonance avoiding method according to the third embodiment achieves a suspension function using the combined elastic force of the first and second elastic members before the rotating speed W3, and then, achieves a suspension function using the elastic force of the second elastic member from the rotating speed W3 to a rotating speed W4, thereby avoiding resonance of the washing machine by means of the respective elastic members.

Meanwhile, when it is determined at the determination step S12 that the rotating speed W of the drum is less than the rotating speed W3, the resonance avoiding method is returned to the accelerating step S10. When it is determined at the determination step S14 that the rotating speed W of the drum is less than the resonance speed P2, the method is returned to the elastic force reducing step S13. If the rotating speed W of the drum reaches the rotating speed W4 after performing the determination step S14, the supply of electric current to the solenoid unit is interrupted.

As apparent from the above description, the suspension apparatus and the resonance avoiding method of the drum-type washing machine have the following effects.

Firstly, the suspension apparatus of the drum-type washing machine according to the present invention can provide different elastic forces at specific rotating speeds of a drum, thereby avoiding resonance of the washing machine.

Secondly, the suspension apparatus of the drum-type washing machine according to the present invention can combine or reduce the elastic forces of respective elastic members, thereby preventing the generation of resonance during a dehydration cycle of the drum-type washing machine.

Thirdly, the suspension apparatus of the drum-type washing machine according to the present invention is designed such that the elastic forces of the elastic members are combined or subtracted under the influence of a magnetic force generated in a solenoid unit, enabling accurate operation thereof.

Fourthly, since the suspension apparatus of the drum-type washing machine according to the present invention is designed so as not to pass a resonance speed range during the dehydration cycle, there is no risk of damage to the washing machine due to excess vibration.

Finally, the resonance avoiding method of the drum-type washing machine according to the present invention comprises an elastic force combining step or elastic force reducing step before the drum reaches a resonance speed, thereby preventing generation of excess vibration due to resonance during the dehydration cycle of the washing machine.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The present disclosure relates to subject matter contained in Korean Application No. 10-2004-41172, filed on Jun. 5, 2004, the contents of which are herein expressly incorporated by reference in its entirety.

What is claimed is:

1. A suspension apparatus of a drum-type washing machine having a cabinet assembly and a tub, the suspension apparatus comprising:

a main elastic member mounted between the cabinet assembly and the tub to perform a vibration absorbing operation;

an auxiliary elastic member mounted to the tub; and an actuator that enables the auxiliary elastic member to perform the vibration absorbing operation when a rotational speed of the drum exceeds a predetermined speed, wherein a bar is protruded from the cabinet assembly toward the tub, and a guide plate is protruded around the main elastic member from the tub toward the cabinet assembly such that a free end of the bar is slidably inserted into the guide plate, wherein the main elastic member is inserted into the guide plate between the free end of the bar and the tub, wherein the auxiliary elastic member comprises a pair of coil springs, one coil spring being disposed at a left side of the main elastic member, the other coil spring being disposed at a right side of the main elastic member, and wherein the actuator comprises a pair of solenoids, each solenoid mounted at a free end of one of the coil springs, one solenoid being disposed at a left side of the bar and the other solenoid being disposed at a right side of the bar, to be attachable to the sides of the bar such that the pair of coil springs perform the vibration absorbing operation together with the main elastic member.

2. The apparatus as set forth in claim 1, wherein:

the bar extends vertically.

3. The apparatus as set forth in claim 1, wherein a guide plate is provided around the auxiliary elastic member to prevent the auxiliary elastic member from dislocating.

4. The apparatus as set forth in claim 1, wherein the main elastic member comprises a coil spring.

5. The apparatus as set forth in claim 1, wherein the main elastic member and auxiliary elastic member are disposed in parallel.

6. The apparatus as set forth in claim 1, wherein the main elastic member and the auxiliary elastic member are disposed in a perpendicular direction of the washing machine.

* * * * *